US008652616B2

(12) United States Patent
Courtenay et al.

(10) Patent No.: US 8,652,616 B2
(45) Date of Patent: Feb. 18, 2014

(54) SYSTEM AND METHOD FOR REDUCING A RE-FLOCCING TENDENCY A NANOMILLED CALCIUM CARBONATE

(75) Inventors: Silke Courtenay, San Diego, CA (US); Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1467 days.

(21) Appl. No.: 11/431,252

(22) Filed: May 10, 2006

(65) Prior Publication Data

US 2007/0264449 A1 Nov. 15, 2007

(51) Int. Cl.
*B41M 5/50* (2006.01)

(52) U.S. Cl.
USPC ..... 428/195.1; 428/32.34; 428/206

(58) Field of Classification Search
USPC ..... 428/32.34, 32.35, 195.1, 206; 241/16; 524/425
See application file for complete search history.

(56) References Cited

U.S. PATENT DOCUMENTS

| | | | | |
|---|---|---|---|---|
| 4,175,066 | A * | 11/1979 | Shibazaki et al. | 524/425 |
| 5,783,038 | A * | 7/1998 | Donigian et al. | 162/135 |
| 7,018,455 | B2 | 3/2006 | Kitamura et al. | |
| 7,033,016 | B2 | 4/2006 | Yoshida et al. | |
| 7,036,924 | B2 | 5/2006 | Kaieda et al. | |
| 7,037,553 | B2 | 5/2006 | Endo et al. | |
| 2005/0133178 | A1 * | 6/2005 | Dougherty et al. | 162/135 |
| 2005/0221026 | A1 * | 10/2005 | Superka et al. | 428/32.34 |
| 2007/0227402 | A1 | 10/2007 | Hui | |

FOREIGN PATENT DOCUMENTS

| | | | |
|---|---|---|---|
| JP | 09194669 | A * | 7/1997 |
| WO | 2004003093 | A1 | 1/2004 |
| WO | 2005103377 | A1 | 11/2005 |

OTHER PUBLICATIONS

Machine translation of detailed description of JP 09-194669 A. Created on Oct. 5, 2009 as JP09_194669detail.pdf.*
MSDS of Acumer 9300 acquired on Mar. 11, 2010 from http://www.rohmhaas.com/wcm/products/product_print.page?display-mode=msds&product=1120173.*
MSDS of Darvan 7 acquired on Mar. 11, 2010 from http://www.standardceramic.com/MSDSmaterials/Darvan%207.pdf.*
MSDS of Darvan C acquired on Mar. 11, 2010 from http://www.rtvanderbilt.com/documents/MSDS/US/13710.pdf.*
HPDC, Chinese Office Action dated Jul. 28, 2010, Chinese Pat. App. 200680039992.2.
HPDC, Chinese Office Action dated Apr. 26, 2011, Chinese Pat. App. 200680039992.2, 3 p.

* cited by examiner

*Primary Examiner* — Gerard Higgins

(57) ABSTRACT

A method for forming a printable coating includes providing a calcium carbonate, combining a dispersant with the calcium carbonate, nanomilling the calcium carbonate and the dispersant to inhibit re-floccing of the nanomilled calcium carbonate, and combining the mixture with a binder at alkaline pH. According to one exemplary embodiment, the coating may be applied to one or more sides of a media substrate.

12 Claims, 3 Drawing Sheets

SYSTEM AND METHOD FOR REDUCING A RE-FLOCCING TENDENCY A NANOMILLED CALCIUM CARBONATE

BACKGROUND

Wide-spread use of personal computers and printers has created an increased demand for high quality printing mediums. Digital cameras have also created a need for convenient, high quality printing capabilities. Though there have been many developments in printing technology, there are always demands for better picture resolution, color formation, image stability, etc.

Print media is commonly paper, but can also be plastics, metals, composites, fabrics etc. Specialty print media have been developed for many different uses including: photo quality paper, high and soft gloss paper, matte paper, photo copy paper, color paper, etc. These print media serve as the image receiver from a printing device. In the case of inkjet printers the print media receives ink droplets from ink cartridges to create a desired image.

The print quality of printing operations has traditionally been limited by characteristics of the print media. To enhance the image effect in printing, a coated print media such as paper is often used. Traditional coated print media are coated with pigment compositions and other functional materials configured to promote ink transfer. Additionally, traditional print media coatings and processes are used to enhance the gloss and surface smoothness of the uncoated print media. Differences in various print media characteristics are due to differences in the type of coating used.

SUMMARY

A method for lowering a tendency of a nanomilled calcium carbonate to re-floc includes combining the nanomilled calcium carbonate with an anionic or non-ionic dispersant.

BRIEF DESCRIPTION OF THE DRAWINGS

The accompanying drawings illustrate various embodiments of the present system and method and are a part of the specification. Together with the following description, the drawings demonstrate and explain the principles of the present system and method. The illustrated embodiments are examples of the present system and method and do not limit the scope thereof.

Throughout the drawings, identical reference numbers designate similar but not necessarily identical elements.

DETAILED DESCRIPTION

The present specification describes an exemplary coating to be formed on a desired substrate to improve glossiness. The exemplary coating exhibits a lower tendency of re-floccing and/or agglomeration of nanomilled calcium carbonate particles, when compared to traditional coatings, thus allowing a glossy coating. According to one exemplary embodiment disclosed herein, a paperpulp base media is coated on at least one side with a layer that exhibits a relatively low tendency for re-floccing, and hence increased glossiness. Further details of the present formulation will be provided below.

Before particular embodiments of the present system and method are disclosed and described, it is to be understood that the present system and method are not limited to the particular process and materials disclosed herein as such may vary to some degree. It is also to be understood that the terminology used herein is used for the purpose of describing particular embodiments only and is not intended to be limiting, as the scope of the present system and method will be defined only by the appended claims and equivalents thereof.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

In the following description, for purposes of explanation, numerous specific details are set forth in order to provide a thorough understanding of the present system and method for forming a printable coating comprising nanomilled calcium carbonate which exhibits a generally low tendency to re-floc. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Overall Structure

Figure 1:
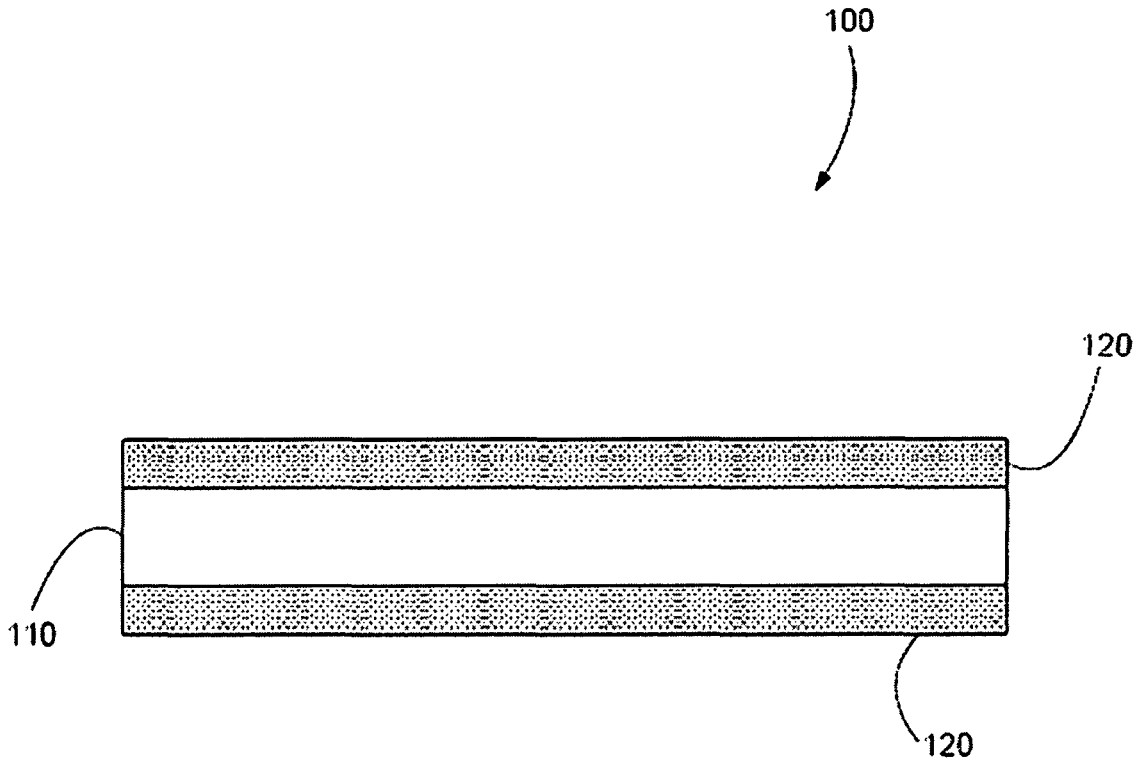
FIG. 1 is a cross-sectional view of a print media, according to one exemplary embodiment.

While the present system and method may be practiced by any number of methods and on any number of surfaces, the present system and method will be described herein, for ease of explanation only, in the context of forming a printable coating on a paper or resin coated substrate. FIG. 1 illustrates a cross-sectional view of an exemplary media (100), according to one exemplary embodiment. As illustrated in FIG. 1, the exemplary print media (100) includes at least two components: a base media substrate (110) and a printable coating (120) disposed on the base media substrate (110). However, according to another exemplary embodiment the printable coating may be formed on one or both sides of the desired base media. According to the present exemplary embodiment, the anti-agglomeration performance of the print media (100) is attributed, at least in part, to the composition of the printable coating (120). The base media substrate (110) and the printable coating (120) will now be described in further detail below.

Base Media

As shown in FIG. 1, the base media substrate (110) forms the base of the print media. The present exemplary print media will be described herein, for ease of explanation only, in the context of a paper stock base media. However, it will be understood by one of ordinary skill in the art that any number of base media materials may be used by the present system and method including, but in no way limited to, paper base, pigmented paper base, cast-coated paper base, foils, and films. Further the exemplary base media can include an offset coating or a resin coating. Alternatively, the exemplary base media may also be a non-paper based substrate such as a film, a foil, a textile and the like.

Printable Coating

According to one exemplary embodiment, the printable coating (120) formulation disposed on the base media substrate (110) comprises from approximately 80 to 100 parts nanomilled calcium carbonate with a dispersant and up to 20 parts binder wherein said binder is compatible with both said calcium carbonate and said dispersant.

Coatings based on calcium carbonate chemistry may be selected to form printable coatings, according to one exemplary embodiment, due to the ability of calcium carbonate pigment to supply increased brightness, opacity, smoothness, and gloss when compared to other traditional inorganic pigments. Nanomilled calcium carbonate has smaller particle sizes than traditionally used natural ground calcium carbonate (GCC) and chemical precipitated calcium carbonate (PCC). Particle size and shape are important to functional features of coatings such as brightness, shade, opacity, gloss. Specifically, smaller particle size typically relates to improved brightness, shade, opacity and gloss. Nanomilled calcium carbonate particles can be spherical or non-spherical and are typically less than 150 nanometers in length or diameter. An obstacle in working with small calcium carbonate particles is flocculation. As a formulation is processed, small calcium carbonate particles tend to flocculate and form larger aggregates. Flocculation of nano-milled calcium carbonate adversely affects its brightness, shade, opacity, gloss, and other functionalities.

To address the processing and performance issues associated with flocculation of nano-milled calcium carbonate, the present exemplary system and method incorporate a non-ionic or anionic dispersant that prevents flocculation of nanomilled calcium carbonate. Any number of compatible anionic or non-ionic dispersants may be used with the present exemplary system and method. However, according to one exemplary embodiment, commercially available anionic dispersant DARVAN 7 (Sodium polymethacrylate), DARVAN C (Ammonium polymethacrylate (2-propenoic acid, 2-methyl ammonium salt, homopolymer)), or ACUMER 9300 (Polycarboxylate, sodium salt) can be used as the dispersant. Dispersants function to decrease the surface energy or chemical potential of a species in a mixture and/or solution. A lower chemical potential or surface energy typically increases the tendency for the species to remain distributed in a mixture and/or solution. According to one exemplary embodiment, small calcium carbonate particles have an increased tendency to remain as small, dispersed particles when any anionic or nonionic dispersant such as, by way of example only, DARVAN 7 (Sodium polymethacrylate), DARVAN C (Ammonium polymethacrylate (2-propenoic acid, 2-methyl ammonium salt, homopolymer)), or ACUMER 9300 (Polycarboxylate, sodium salt) is present in the system.

As illustrated in FIG. 1, the printable coating (120) adheres to the base media substrate (110). Binders may be used to maintain printable coating cohesion, i.e. keeping the particles together, and may also help with the coating adhesion to the base media substrate. According to one exemplary embodiment, the printable coating formulation comprises up to 20 parts binder. The binder is maintained at an alkaline pH in order to be compatible with the calcium carbonate and the dispersant. An alkaline pH influences particle size by preventing the calcium carbonate from dissolving, as well as affecting print media properties such as gloss, surface charge, and capacity. The binder should be compatible in order to maintain the functional properties of both the dispersant and calcium carbonate. Examples of some suitable binders for use with the present exemplary formulation include, but are in no way limited to, binders based on polyurethane, anionic or non-ionic latexes, as well as swellable polymers such as polyvinylpyrrolidone/polyvinylimidazol copolymer, polyvinylalcohol, polyvinylacetate, and cellulose. The above-mentioned coating formulation, when formed and applied to a desired substrate as described in detail below, prevents refloccing of the nanomilled calcium carbonate, thereby enhancing the brightness, shade, opacity and gloss of the coating.

Exemplary Implementation and Operation

Figure 2:
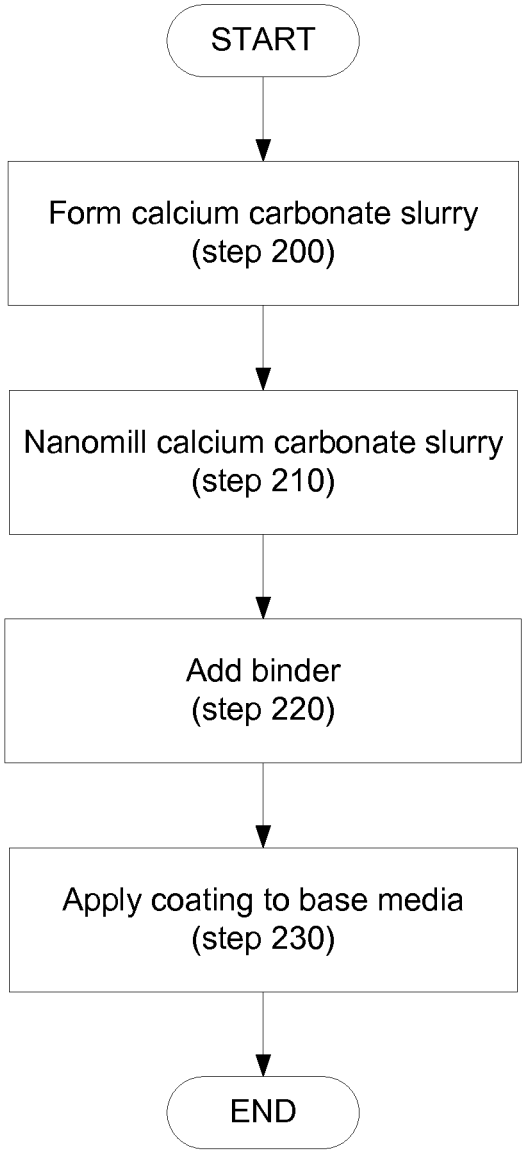
FIG. 2 is a flow chart illustrating a method for forming a printable coating, according to one exemplary embodiment.

FIG. 2 illustrates an exemplary method for forming a print media (100) according to one exemplary embodiment. As illustrated in FIG. 2, the exemplary method begins by first, combining a dispersant and a calcium carbonate (step 200). Once combined, the calcium carbonate and a dispersant may be nanomilled (step 210). The dispersant-calcium carbonate mixture is then mixed with a binder (step 220) to complete the printable coating formulation. The resulting printable coating formulation is then formed on at least one surface of the base media substrate (step 230). The independent steps of the above-mentioned method will now be described in further detail below.

As shown in FIG. 2, the first step of the present exemplary method is to form a calcium carbonate slurry (step 200). The calcium carbonate slurry may include PCC and/or GCC and dispersant. Examples of possible PCC and/or GCC that may be used with the present exemplary system and method include, but are in no way limited to, commercially available Hydrocarb 60, Multiflex MM, or Opacarb A 40. Suitable dispersants for use in the present exemplary systems and methods include, but are in no way limited to, DARVAN 7 (Sodium polymethacrylate), DARVAN C (Ammonium polymethacrylate (2-propenoic acid, 2-methyl ammonium salt, homopolymer)), or ACUMER 9300 (Polycarboxylate, sodium salt). According to one exemplary embodiment, the exemplary slurry contains approximately 40% solids in water and up to 2.5% dispersant.

Once the above-mentioned calcium carbonate slurry is formed, it is then nanomilled (step 210). According to one exemplary embodiment, the exemplary slurry is loaded into a re-circulation tank and pumped through a grinding chamber loaded with Yttrium Stabilized Zirconium (YTZ) beads. YTZ beads suitable in the present exemplary embodiment typically range from 0.1 to 0.3 mm in diameter. The nanomilling process is capable of, but not required to, generate agglomerated calcium carbonate particles as small as 70 nm. Tables 1 and 2 present properties of calcium carbonate particles resulting from several nano-milling processes similar to those described herein.

TABLE 1

| Material | Surfactant | Final Solids % | Final Surfactant % | Beads (mm) | Final particle size (Vol. Median microns) | Final particle size (Number Median) |
|---|---|---|---|---|---|---|
| Hydrocarb 60 | Darvan 7 | 73 | 2.50 | 0.2 | 0.193 | 0.107 |
| Hydrocarb 60 | Darvan 7 | 24.3 | 1.20 | 0.1 | 0.142 | 0.0907 |

TABLE 1-continued

| Material | Surfactant | Final Solids % | Final Surfactant % | Beads (mm) | Final particle size (Vol. Median microns) | Final particle size (Number Median) |
|---|---|---|---|---|---|---|
| Hydrocarb 60 | Acumer 9300 | | 12.5 | 0.3 | 0.193 | 0.093 |
| MultiflexMM | Acumer 9300 | | 12.5 | 0.3 | 0.126 | 0.08 |
| MultiflexMM | Darvan 7 | 40 | 2.80 | 0.2 | 0.138 | 0.073 |
| MultiflexMM | Darvan 7 | 27 | 1.10 | 0.1 | 0.128 | 0.0776 |
| MultiflexMM | Acumer 9300 | 26.4 | 3.00 | 0.1 | 0.082 | 0.071 |
| OpcarbA40 | Darvan 7 | 43 | 1.60 | 0.2 | 0.174 | 0.076 |
| OpcarbA40 | Acumer 9300 | 25 | 1.30 | 0.1 | 0.1576 | 0.11 |

After the exemplary slurry is nanomilled by the nanomilling process, a binder is added (step 220) to create a cohesive printable coating formulation. According to one exemplary embodiment, the formation of the printable coating formulation includes mixing up to 20 parts binder with between 80 and 100 parts dispersant-calcium carbonate mixture. When combined, the binder serves to hold the dispersant-calcium carbonate mixture together. In addition, the binder may also adhere the formulation to the base media. Examples of suitable binders in the present exemplary embodiment include, but are in no way limited to, binders based on polyurethane, anionic or non-ionic latexes, as well as swellable polymers such as polyvinylpyrrolidone/polyvinylimidazol copolymer, polyvinylalcohol, polyvinylacetate, and cellulose.

In addition to the above-mentioned components, the present exemplary coating formulation may also include any number of additives such as mordents, surfactants, viscosity modifiers, surface tension adjusting agents, rheology adjusting agents, pH adjusting agents, drying agents, colors, and the like, as is well known in the art.

When the printable coating formulation is formed, layer(s) and/or top image receiving layer(s) can be applied to one or more sides of a base media (step 230). The layer(s) can be applied to the base media using an on-machine or off-machine coater. Examples of suitable coating techniques include, but are not limited to, slotting die coaters, roller coaters, curtain coaters, blade coaters, rod coaters, air knife coaters, gravure application, air brush application and other techniques and apparatuses known to those skilled in the art.

Figure 3:
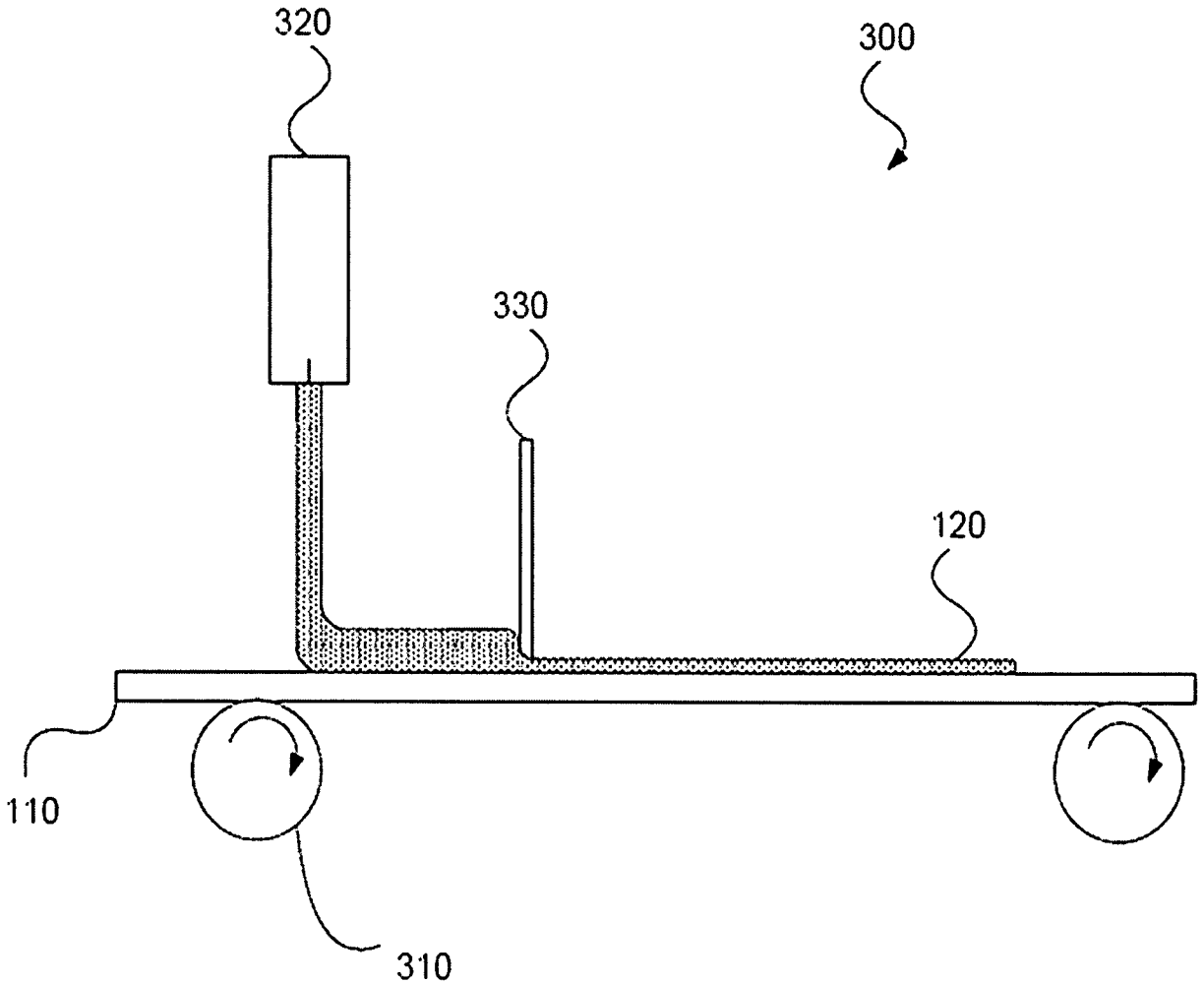
FIG. 3 is a cross-sectional side-view of a print media formation apparatus, according to one exemplary embodiment.

FIG. 3 illustrates a knife coating apparatus (300) according to one exemplary embodiment. As illustrated in FIG. 3, a substrate (110) may be translated adjacent to a material dispenser (320) by a number of transport rollers (310), belts, or other translating device. As the base media substrate (110) is passed adjacent to the material dispenser (320), material forming the pigment coating (120) is dispensed from the material dispenser by gravity or under pressure. As illustrated, the material forming the pigment coating (120) then coats the base media substrate (110). As the base media substrate (110) having the pigment coating (120) thereon is further translated by the transport rollers (310), it is passed under a knife (330) that scrapes off any extra pigment coating (120). According to this exemplary embodiment, the speed of the rollers (310) or other translating device, as well as the gap between the knife (330) and the base media (1100 may be selectively varied to modify the thickness of the pigment coating (120) on the base media substrate (110).

According to one exemplary embodiment, a single layer of pigment coating (120) may be formed on the base media substrate (110). Alternatively multiple layers including a base layer and top layers of pigment coating (120) may be formed in the base media substrate (110) to achieve a desired coating.

In conclusion, the present system and method for forming a printable coating comprising nanomilling a calcium carbonate with nonionic/anionic dispersants to form a stable dispersion and then forming a printable coating with a compatible binder and any other necessary additives.

The preceding description has been presented only to illustrate and describe the present method and system. It is not intended to be exhaustive or to limit the present system and method to any precise form disclosed. Many modifications and variations are possible in light of the above teaching.

The foregoing embodiments were chosen and described in order to illustrate principles of the system and method as well as some practical applications. The preceding description enables others skilled in the art to utilize the method and system in various embodiments and with various modifications as are suited to the particular use contemplated. It is intended that the scope of the method and system be defined by the following claims.

What is claimed is:

1. A substrate, comprising:

a base substrate; and a dried printable coating on at least one side of said base substrate, wherein said dried printable coating further includes nanomilled calcium carbonate, a dispersant, and a binder wherein said binder comprises a polyurethane, wherein the particle size of the nanomilled calcium carbonate is less than 150 nanometers in length or diameter, wherein the dispersant is an anionic or non-ionic dispersant that prevents flocculation of the nanomilled calcium carbonate, and wherein the binder was maintained at an alkaline pH to prevent re-flocculation of the nanomilled calcium carbonate.

2. The substrate of claim 1, wherein the dried printable coating comprises from 80 to 100 parts nanomilled calcium carbonate and dispersant mixture by weight, and from 0 to 20 parts binder by weight.

3. The substrate of claim 1, wherein said binder further comprises one or more of an anionic latex, a non-ionic latex, a swellable polymer, polyvinylalcohol, polyvinylacetate, or a cellulose.

4. The substrate of claim 1, wherein said dispersant comprises one of sodium polymethacrylate, ammonium polymethacrylate (2-propenoic acid, 2-methyl ammonium salt, homopolymer), or polycarboxylate, sodium salt.

5. A method of forming a substrate according to claim 1, comprising:

providing a calcium carbonate;

combining an anionic or non-ionic dispersant with said calcium carbonate;

nanomilling said calcium carbonate and dispersant mixture to produce nanomilled calcium carbonate having a particle size less than 150 nanometers in length or diameter;

combining said nanomilled calcium carbonate and dispersant with a binder, to form a coating mixture wherein said binder comprises a polyurethane; and applying said coating mixture to a substrate, wherein said binder is maintained at an alkaline pH, said coating mixture exhibiting a lower tendency to re-flocculate compared to a coating mixture not prepared by this method.

6. The method of claim 5, wherein said calcium carbonate comprises providing from 90 to 100 parts calcium carbonate by weight.

7. The method of claim 6, wherein combining said nanomilled calcium carbonate and dispersant with a binder comprises providing less than 20 parts binder by weight.

8. The method of claim 5, wherein said binder further comprises at least one or more of an anionic latex, a non-ionic latex, or a swellable polymer polyvinylalcohol, polyvinylacetate, or a cellulose.

9. A method of claim 5, wherein said dispersant comprises an anionic dispersant.

10. The method of claim 9, wherein said anionic dispersant comprises one of sodium polymethacrylate, ammonium polymethacrylate (2-propenoic acid, 2-methyl ammonium salt, homopolymer), or polycarboxylate, sodium salt.

11. The method of claim 5, wherein said coating mixture comprises:

80 to 100 parts calcium carbonate; and less than 20 parts binder by weight.

12. A substrate, comprising:

a base substrate; and a dried printable coating on at least one side of said base substrate;

wherein said dried printable coating is formed by a process comprising applying to said base substrate a coating formulation prepared by a process comprising:

nanomilling a slurry of calcium carbonate and an anionic or non-ionic dispersant, wherein the particle size of the nanomilled calcium carbonate is less than 150 nanometers in length or diameter, wherein the anionic or non-ionic dispersant prevents re-flocculation of the nanomilled calcium carbonate in the nanomilled slurry, and mixing the nanomilled slurry with a binder maintained at an alkaline pH to prevent re-flocculation of the nanomilled calcium carbonate wherein said binder comprises a polyurethane.

* * * * *

UNITED STATES PATENT AND TRADEMARK OFFICE

CERTIFICATE OF CORRECTION

PATENT NO. : 8,652,616 B2
APPLICATION NO. : 11/431252
DATED : February 18, 2014
INVENTOR(S) : Silke Courtenay et al.

It is certified that error appears in the above-identified patent and that said Letters Patent is hereby corrected as shown below:

On the title page, item (54), and in the Specification, in column 1, line 2, Title, delete "A NANOMILLED" and insert -- OF NANOMILLED --, therefor.

In the Claims

In column 6, line 38, in Claim 1, delete "binder wherein" and insert -- binder, wherein --, therefor.

In column 7, line 2, in Claim 5, delete "mixture" and insert -- mixture, --, therefor.

In column 8, line 22, in Claim 12, delete "carbonate" and insert -- carbonate, --, therefor.

Signed and Sealed this
Sixteenth Day of September, 2014

Michelle K. Lee

Michelle K. Lee
*Deputy Director of the United States Patent and Trademark Office*